US006651779B2

(12) United States Patent
Cecur

(10) Patent No.: US 6,651,779 B2
(45) Date of Patent: Nov. 25, 2003

(54) VALVE LIFT CONTROL UNIT WITH SIMPLIFIED LUBRICATION

(75) Inventor: Majo Cecur, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 14 days.

(21) Appl. No.: 09/944,580

(22) Filed: Aug. 31, 2001

(65) Prior Publication Data

US 2002/0027045 A1 Mar. 7, 2002

(30) Foreign Application Priority Data

Sep. 6, 2000 (EP) ..... 00830601

(51) Int. Cl.[7] ..... F01M 9/08

(52) U.S. Cl. ..... 184/6.5; 184/6.9; 123/90.35; 123/90.55

(58) Field of Search ..... 184/6.5, 6.6, 6.7, 184/6.8, 6.9; 74/605, 587, 567; 123/90.43, 90.45, 90.52, 90.16

(56) References Cited

U.S. PATENT DOCUMENTS 3,630,179 A * 12/1971 Dadd ..... 123/90.35
3,641,990 A * 2/1972 Kinnersly ..... 123/196 R
3,656,582 A * 4/1972 Alcock ..... 184/6.5
3,687,231 A * 8/1972 Scheiterlein ..... 184/6.5
3,838,669 A * 10/1974 Dadd ..... 123/90.35
3,880,127 A * 4/1975 Abell, Jr. ..... 123/90.35
3,902,467 A * 9/1975 Cornell ..... 123/90.35
3,967,602 A * 7/1976 Brown ..... 123/90.55
3,973,532 A * 8/1976 Litz ..... 123/317
4,050,544 A * 9/1977 Kalyan et al. ..... 184/6.6
4,227,495 A * 10/1980 Krieg ..... 123/90.55
4,258,673 A * 3/1981 Stoody et al. ..... 123/90.34
4,343,270 A * 8/1982 Kawabe ..... 123/196 V
4,440,121 A * 4/1984 Clancy et al. ..... 123/90.39
4,446,828 A * 5/1984 Bauder et al. ..... 123/196 R
4,463,714 A * 8/1984 Nakamura ..... 123/90.57
4,481,913 A * 11/1984 Wirth ..... 123/90.35

(List continued on next page.)

*Primary Examiner*—David A. Bucci
*Assistant Examiner*—Julie K. Smith
(74) *Attorney, Agent, or Firm*—L. J. Kasper

(57) ABSTRACT

An improved lubrication arrangement for an internal combustion engine of the push tube (59) type. A carrier structure (43) is fixed relative to an upper surface of the cylinder head (31) and includes a fixed fulcrum location (49) for each rocker arm (51). The carrier structure (43) defines a lubrication passage (67,69) providing lubrication fluid to the fixed fulcrum location (49). The engine block (11) and the cylinder head (31) cooperate to define a fluid chamber (81) surrounding the push tube (59). Lubrication fluid flows out adjacent the fixed fulcrum location (49) and flows under the influence of gravity into the fluid chamber (81). The push tube defines a plurality of openings (83) whereby lubrication fluid flows from the fluid chamber (81) into the interior (85) of the push tube. The push tube and a lash compensation device (27) cooperate to define a fluid passage (87) permitting lubrication fluid to flow from the interior of the push tube into a fluid reservoir (29) defined by the lash compensation device. The described arrangement reduces the need for expensive gun drilling of fluid passages in the engine block and in a rocker shaft, which is replaced in the invention by the carrier structure.

2 Claims, 4 Drawing Sheets

U.S. PATENT DOCUMENTS 4,515,110 A * 5/1985 Perry ..... 123/41.37
4,601,267 A * 7/1986 Kronich ..... 123/90.33
4,616,610 A * 10/1986 Ishida ..... 123/196 A
4,656,976 A * 4/1987 Rhoads ..... 123/90.12
4,694,786 A * 9/1987 Bilek et al. ..... 123/73 AD
4,763,760 A * 8/1988 Haman et al. ..... 184/6.5
4,788,947 A * 12/1988 Edelmayer ..... 123/90.55
4,790,273 A * 12/1988 Oguri et al. ..... 123/196 W
4,838,516 A * 6/1989 Meistrick et al. ..... 251/77
5,152,373 A * 10/1992 Callies ..... 184/6.5
5,398,648 A * 3/1995 Spath et al. ..... 123/90.16
5,456,136 A * 10/1995 Yamashita et al. ..... 74/569
5,513,603 A * 5/1996 Ang et al. ..... 123/90.37
5,588,504 A * 12/1996 Spiegel et al. ..... 184/6.8
5,806,478 A * 9/1998 Oberg ..... 123/90.61
5,829,397 A * 11/1998 Vorih et al. ..... 123/90.12
5,855,191 A * 1/1999 Blowers et al. ..... 123/90.36
5,860,398 A * 1/1999 Koerner ..... 123/90.48
5,899,383 A * 5/1999 Hickey et al. ..... 239/88
6,039,018 A * 3/2000 Spath ..... 123/90.55
6,092,497 A * 7/2000 Preston et al. ..... 123/90.16
6,138,634 A * 10/2000 Kusche et al. ..... 123/196 R
6,196,175 B1 * 3/2001 Church ..... 123/90.16
6,202,620 B1 * 3/2001 Yamaguchi ..... 123/196 R
6,257,183 B1 * 7/2001 Vorih et al. ..... 123/90.12
6,321,701 B1 * 11/2001 Vorih et al. ..... 123/90.12

* cited by examiner

VALVE LIFT CONTROL UNIT WITH SIMPLIFIED LUBRICATION

BACKGROUND OF THE DISCLOSURE

The present invention relates to an improved valve gear train for an internal combustion engine, and more particularly, to an improved and simplified lubrication arrangement for the valve gear train.

In certain types of internal combustion engines, each of the rocker arms, which control the opening and closing movement of the engine poppet valves, is pivoted by means of a push rod. The upper end of the push rod is in engagement with the rocker arm, while the opposite (lower) end of the push rod is in engagement with a cam follower assembly, which receives a cyclical input motion by its engagement with a cam profile on the engine cam shaft. Typically, the cam follower is a roller member and the assembly includes a hydraulic lash compensation element.

Thus, the present invention is directed primarily to internal combustion engines known generically as being of the push rod type. More particularly, the invention relates to an engine valve gear train in which the push rod is specifically a hollow push tube, rather than a solid rod. In some engine designs, a hollow push tube is used to transmit the cyclical motion of the cam lobe into corresponding motion of the rocker arm, so that the hollow push tube can comprise part of the engine lubricant circuit.

The type of valve gear train described above has been in widespread commercial use throughout the world, has become increasingly popular, and has performed in a generally satisfactory manner. However, in such valve gear train using hollow push tubes, it has typically been necessary to gun drill both the engine block and the rocker arm shaft to provide the necessary lubricant passages. The gun drilled passage in the engine block would intersect the bore in which the cam follower assembly is disposed, thereby providing oil to the hydraulic lash compensation element of the follower assembly.

The gun drilled passage in the rocker arm shaft would be primarily for the purpose of lubricating the rocker arm, and its various interfaces with other valve gear train components, such as the poppet valve and the push tube. As is well know to those skilled in the art of engine manufacturing, gun drilling adds substantially to the cost and complexity of machining the cylinder block and the rocker arm shaft, thus adding substantially to the overall manufacturing cost of the engine.

BRIEF SUMMARY OF THE INVENTION

Accordingly, it is an object of the present invention to provide an improved lubrication arrangement for an internal combustion engine of the type having a push tube valve gear train, which overcomes the above-described problems of the prior art lubrication arrangement.

It is a more specific object of the present invention to provide such an improved lubrication arrangement for a push tube type valve gear train which eliminates the necessity of gun drilling lubricant passages in the engine block and the rocker arm shaft.

It is a further object of the present invention to provide an improved lubrication arrangement which achieves the above-stated objects, and in which lubricant is communicated to the interior of the push tube primarily by splash oil within the cylinder head.

The above and other objects of the invention are accomplished by the provision of an improved lubrication arrangement for an internal combustion engine of the type including an engine block defining a combustion chamber and a cam shaft rotatably supported relative to the engine block for providing cyclical input motion. A cylinder head is in operable engagement with the engine block and includes poppet valve means for controlling the flow to and from the combustion chamber. A rocker arm is pivotable about a fixed fulcrum location and includes a valve contacting portion in engagement with the poppet valve means for transmitting the cyclical input motion thereto. The engine includes a source of pressurized fluid and the cylinder head defines a main fluid passage in fluid communication with the source. A cam follower, including a hydraulic lash compensation device, is operably associated with the cam shaft, and a push tube is disposed in series between the cam follower and the rocker arm and is operable to transmit the cyclical input motion from the cam shaft to the rocker arm.

The improved lubrication system is characterized by a carrier structure fixed relative to an upper surface of the cylinder head and including the fixed fulcrum location. The carrier structure defines a lubrication passage providing fluid communication of lubrication fluid from the main fluid passage to the fixed fulcrum location. The engine block and the cylinder head cooperate to define a fluid chamber surrounding the push tube, whereby the lubrication fluid flows out adjacent the fixed fulcrum location and flows under the influence of gravity into the fluid chamber. The push tube defines a plurality of openings whereby the lubrication fluid flows from the fluid chamber into the interior of the push tube. The push tube and the lash compensation device cooperate to define fluid passage means permitting lubrication fluid to flow from the interior of the push tube into a reservoir defined by the lash compensation device.

DETAILED DESCRIPTION OF THE PREFERRED EMBODIMENT

Figure 1A:
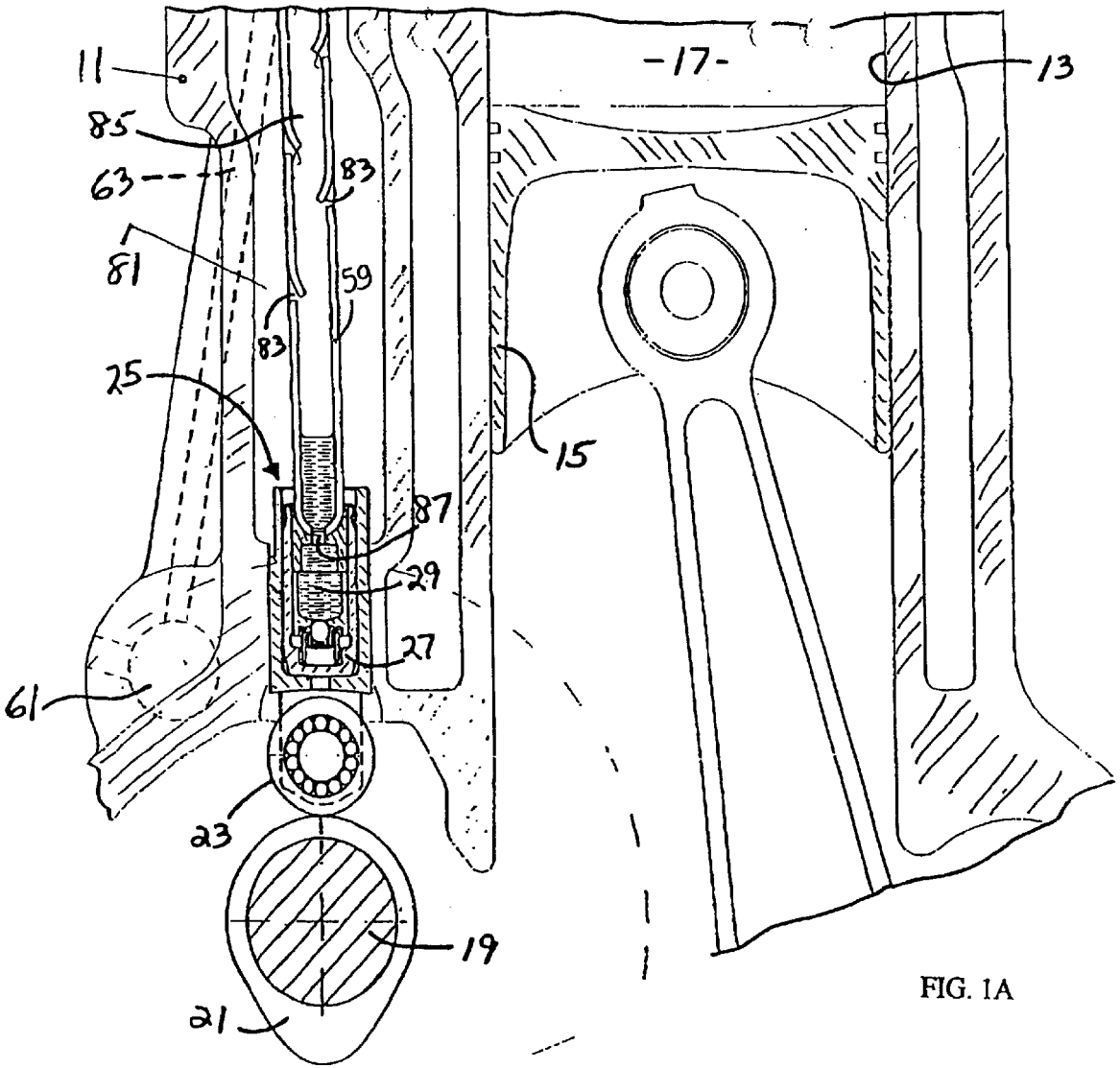
FIGS. 1A and 1B together comprise a fragmentary, transverse cross-section through a vehicle internal combustion engine, including the improved lubrication arrangement of the present invention, FIG. 1A showing primarily the engine block portion of the engine, and FIG. 1B showing primarily the cylinder head portion of the engine.
Figure 1B:
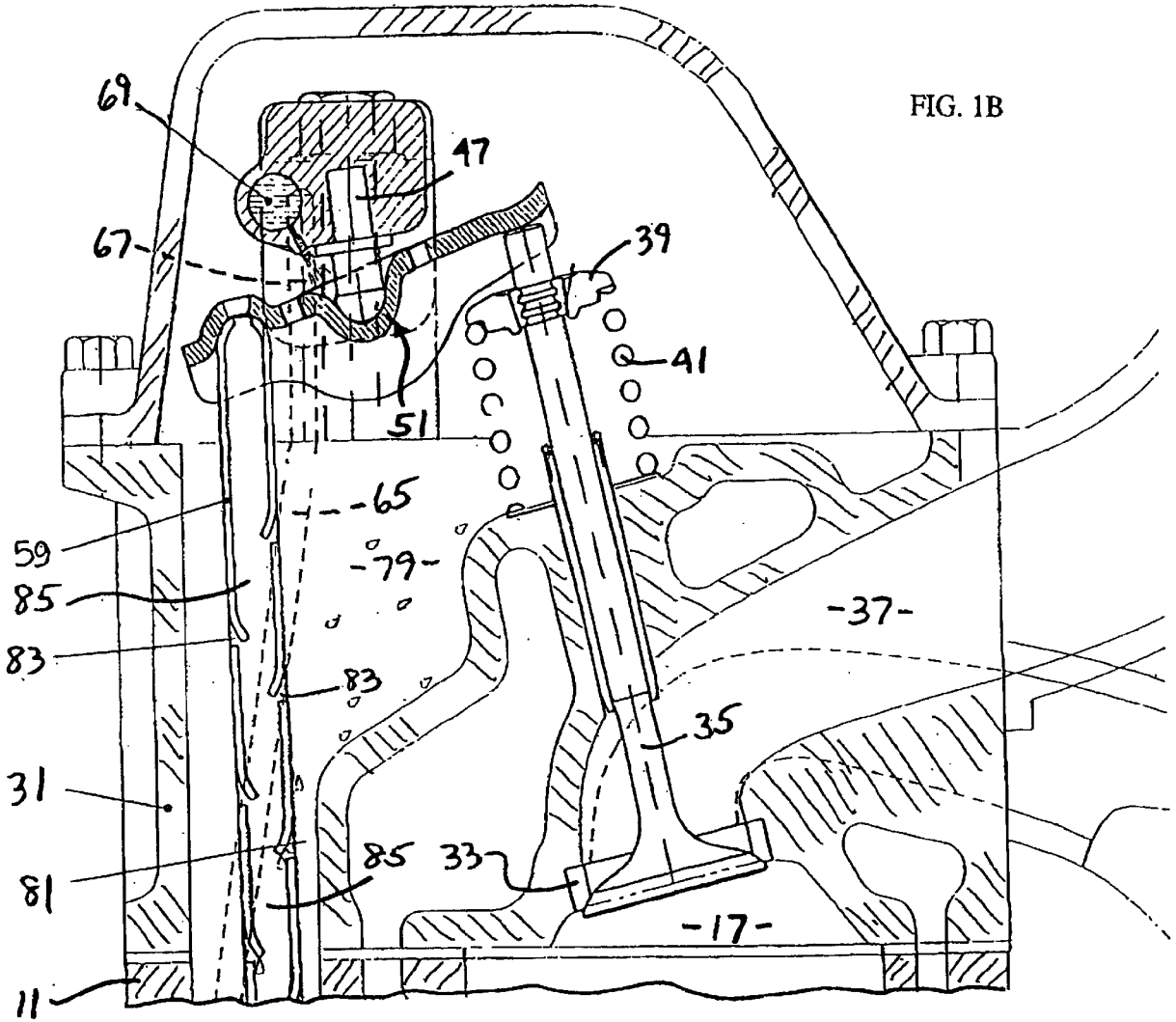

Referring now to the drawings, which are not intended to limit the invention, FIGS. 1A and 1B together illustrate an internal combustion engine including a push tube type of valve gear train. FIG. 1A illustrates, fragmentarily, an engine block 11 defining a cylinder bore 13, and disposed therein for reciprocal movement is a piston 15, the region within the cylinder bore 13, above the piston 15, comprising a combustion chamber 17.

Rotatably disposed within the engine block 11 is a cam shaft 19 including a cam lobe 21, and in operable engagement with the cam lobe (or cam "profile") 21 is a roller 23 of a roller follower assembly, generally designated 25. In the subject embodiment, the roller follower assembly 25 includes a hydraulic lash compensation device 27, the construction details of which are not essential features of the invention, and therefore, the device 27 will not be described further herein. For purposes of describing the present invention, it is sufficient to note that the hydraulic lash compensation device 27 defines a fluid reservoir 29, and as is well know to those skilled in the hydraulic lash compensation art, a supply of lubricant fluid in communication with the reservoir 29 is essential for the proper functioning of the lash compensation device 27.

Referring now primarily to FIG. 1B, the internal combustion engine further includes a cylinder head 31 which cooperates with the cylinder bore 13 and the piston 15 to define an upper portion of the combustion chamber 17. At the upper end of the combustion chamber, and seated within the cylinder head 31 is a valve seat insert 33 against which is seated an engine poppet valve 35, the function of which, as is well know to those skilled in the art, is to control the flow between a passage 37 and the combustion chamber 17. In engagement with the upper end of the stem of the poppet valve 35 is a keeper 39, which serves as a seat for a valve spring 41, the lower end of which is seated against a surface of the cylinder head 31. The valve spring 41 biases the poppet valve 35 toward its normally closed position shown in FIG. 1B.

Figure 2:
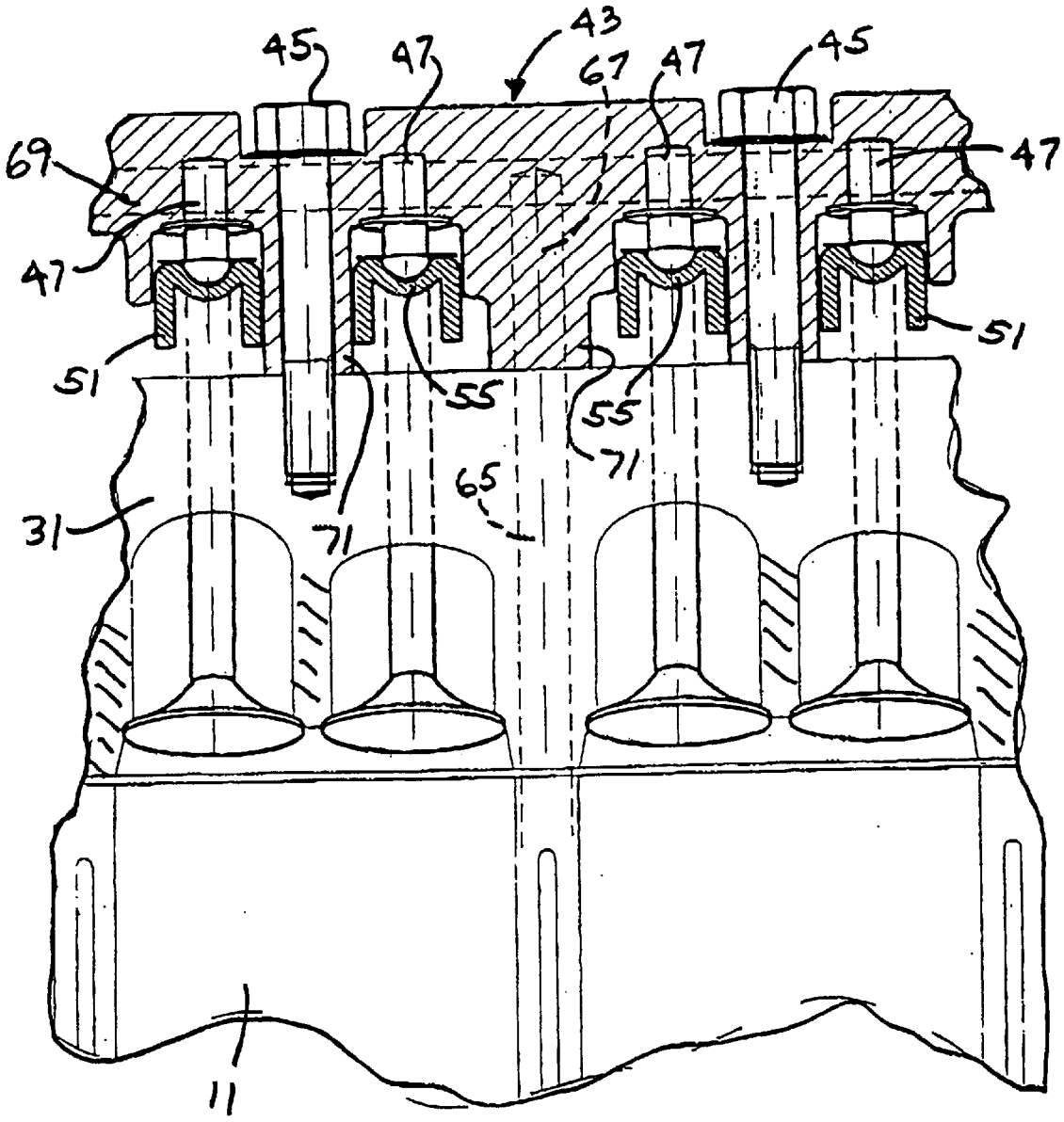
FIG. 2 is a fragmentary, axial cross-section taken through the fixed fulcrum structure shown in FIG. 1B.

Referring still primarily to FIG. 1B, but now in conjunction with FIG. 2, there is a carrier structure, generally designated 43, attached to an upper surface of the cylinder head 31 by means of a plurality of bolts 45. The carrier structure 43 serves several functions, one of which is a support structure for a plurality of fulcrum members 47, each of which includes a generally hemispherical head 49 (see FIG. 3) which serves as a fixed fulcrum location for its respective rocker arm 51. In the subject embodiment, each of the fulcrum members 47 is in threaded engagement within a threaded bore defined by the carrier structure 43.

Figure 3:
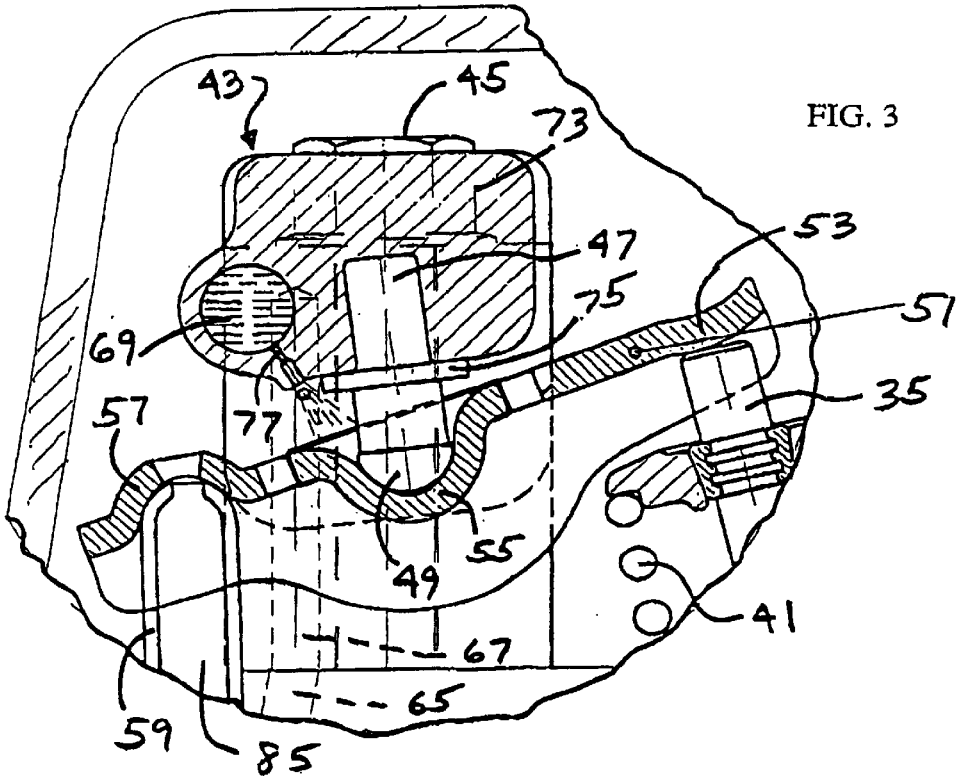
FIG. 3 is an enlarged, fragmentary, transverse cross-section, similar to FIG. 1B, showing the fixed fulcrum and rocker arm in greater detail.
Figure 4:
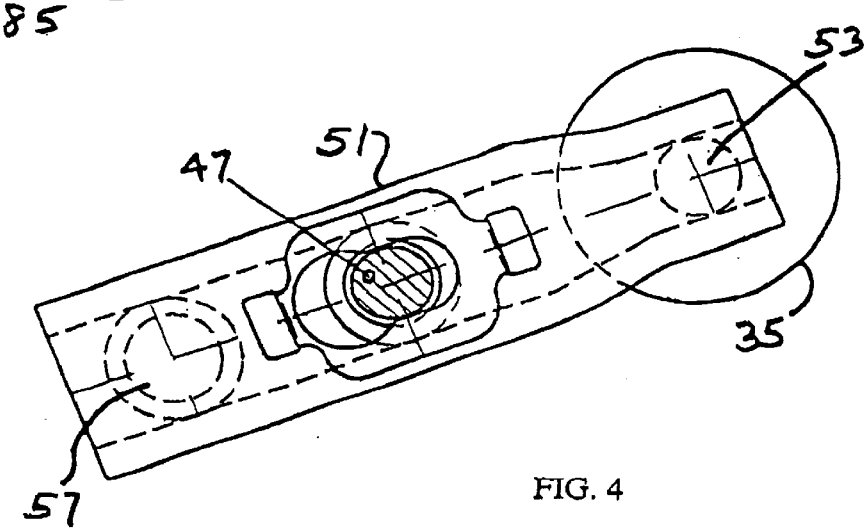
FIG. 4 is a top plan view of the rocker arm shown in FIG. 3, and on approximately the same scale.

Referring still primarily to FIGS. 1B and 2, but now also to FIGS. 3 and 4, the rocker arm 51 includes, at its right end in FIG. 3, a valve contacting portion 53 which is in engagement with the upper end (tip) of the stem of the poppet valve 35, such that pivotal movement of the rocker arm 51 about the fixed fulcrum location 49 results in cyclical opening and closing motion of the poppet valve 35. The rocker arm 51 also includes an upwardly opening portion 55 which receives and engages the fixed fulcrum location 49. In addition, the rocker arm 51 defines a downwardly opening portion 57 which receives and engages an upper hemispherical end of a push tube 59. Preferably, and as is well known in the rocker arm art, the rocker arm 51 may be formed by one or more stamping and/or punching steps.

Referring again primarily to FIGS. 1A and 1B, the engine block 11 includes a source of pressurized lubricant, as is well known to those skilled in the engine art, the source typically comprising a lubrication pump (not shown herein). The outlet of such a pump is in fluid communication with a main fluid passage 61 which extends axially through at least part of the length of the engine block 11, the fluid passage 61 hereinafter, and in the appended claims, being considered the "source" of pressurized lubricant. In fluid communication with the fluid passage 61 is a vertical passage 63 defined by the engine block 11 and, therefore, shown only in FIG. A. The upper end of the vertical passage 63 is in fluid communication with a vertical passage 65 defined by the cylinder head 31. In turn, the upper end of the passage 65 is in fluid communication with a short vertical passage 67 defined by the carrier structure 43, the passage 67 opening into a horizontal passage 69, also defined by the carrier structure 43. It will be understood by those skilled in the art that references herein to passages as either "vertical" or "horizontal" is by way of description only, and not by way of limitation.

Referring now primarily to FIGS. 2 and 3, it may be seen that the carrier structure 43 includes pedestal portions 71, through which the bolts 45 extend and through which the short vertical passage 67 extends. It is the pedestal portions 71 which engage the upper surface of the cylinder head 31. Disposed between adjacent pedestal portions 71 are fulcrum support portions 73 (see FIG. 3), each of the support portions 73 including an under-surface, against which an enlarged portion 75 of each fulcrum member 47 is seated. Disposed immediately adjacent the member 47, the support portion 73 defines a relatively small fluid orifice 77, in open fluid communication with the horizontal passage 69, such that pressurized lubricant in the passage 69 is sprayed through the orifice 77 and onto the interface of the hemispherical head 49 and the upwardly opening portion 55 of the rocker arm 51. The lubricant fluid thus sprayed onto the rocker arm 51 then splashes downwardly into a splash region 79 (see FIG. 1B) defined by the cylinder head 31.

Referring again primarily to FIGS. 1A and 1B, the engine block 11 and the cylinder head 31 cooperate to define a fluid chamber 81 surrounding the push tube 59. In the subject embodiment, the fluid chamber 81 surrounds the push tube 59 over about the lower two-thirds of the total length of the push tube 59, such that the splash fluid which flows out through the orifices 77, adjacent the heads 49 will flow under the influence of gravity, first into the splash region 79, and then into the fluid chamber 81.

In accordance with one important aspect of the invention, the push tube 59 is provided with a series of openings 83 over substantially the entire axial length of the push tube 59. Preferably, the openings 83 comprise punchings to be made from externally of the tube 59, and preferably without removal of material. As a result, during normal operation of the engine, with vertical, reciprocal movement of the push tube in FIGS. 1A and 1B, lubricant fluid will flow from the fluid chamber 81 through the openings 83 into the interior 85 of the push tube 59, typically filling at least a portion of the interior 85 as is shown somewhat schematically in FIG. 1A. The push tube 59 and the cam follower 25 (or the lash compensation device 27) cooperate to define a fluid passage 87, by means of which lubricant fluid can flow from the interior 85 of the push tube 59 into the reservoir 29 within the cam follower 25.

Thus, with the lubrication arrangement of the present invention, there is no need to gun drill a fluid passage through either a rocker arm shaft (which has been replaced by the carrier structure 43 and the fulcrum members 47) or through the engine block. Instead, the lash compensation devices 27 receive lubricant fluid directly through the hollow push tubes 59, as a result of the openings 83.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. An improved lubrication arrangement for an internal combustion engine of the type including an engine block defining a combustion chamber and a camshaft rotatably supported relative to said engine block for providing cyclical input motion; a cylinder head in operable engagement with said engine block and including poppet valve means for controlling the flow to and from said combustion chamber, a rocker arm pivotable about a fixed fulcrum location and including a valve contacting portion in engagement with said poppet valve means for transmitting said cyclical input motion thereto; said engine including a source of pressurized fluid, and said cylinder head defining a main fluid passage in fluid communication with said source; and a cam follower, including a hydraulic lash compensation device operably associated with said camshaft, and a push tube disposed in series between said cam follower and said rocker arm and operable to transmit said cyclical input motion from said camshaft to said rocker arm; characterized by:

(a) a carrier structure fixed relative to an upper surface of said cylinder head and including said fixed fulcrum location, said carrier structure defining a lubrication passage providing fluid communication of lubrication fluid from said main fluid passage to said fixed fulcrum location;

(b) said engine block and said cylinder head cooperating to define a fluid chamber surrounding said push tube, whereby said lubrication fluid flows out adjacent said fixed fulcrum location and flows under the influence of gravity into said fluid chamber;

(c) said push tube defines a plurality of openings whereby said lubrication fluid flows from said fluid chamber into the interior of said push tube; and (d) said push tube and said lash compensation device cooperating to define fluid passage means permitting said lubrication fluid to flow from said interior of said push tube into a reservoir defined by said lash compensation device.

2. An improved lubrication arrangement as claimed in claim 1, characterized by the orientation of the internal combustion engine is such that said push tube is oriented generally vertically.

* * * * *